US005406659A

United States Patent [19]

Camp

[11] Patent Number: 5,406,659

[45] Date of Patent: Apr. 18, 1995

[54] BEACH TOWEL

[75] Inventor: Gary L. Camp, 3104 Pacific Ave., Manhattan Beach, Calif. 90266

[73] Assignee: Gary Lee Camp, Manhattan Beach, Calif.

[21] Appl. No.: 179,148

[22] Filed: Jan. 10, 1994

[51] Int. Cl.[6] ..... A47G 9/06

[52] U.S. Cl. ..... 5/417; 5/485; 52/3

[58] Field of Search ..... 5/417, 485, 418, 419, 5/420; 52/3, 4

[56] References Cited

U.S. PATENT DOCUMENTS 3,226,737 1/1966 Rote ..... 135/115 X
4,466,516 8/1984 Sicoli et al. ..... 5/419 X
4,499,133 2/1985 Prince ..... 52/4 X
4,703,528 11/1987 Rolle ..... 5/417

*Primary Examiner*—Michael F. Trettel
*Attorney, Agent, or Firm*—D'Alessandro & Ritchie

[57] ABSTRACT

A beach towel according to the present invention has a top surface and a bottom surface. The beach towel may be rectangular or of another shape having at least three corners. The bottom surface is adapted to lay flat on the sand of a beach and is provided with a triangle-shaped pocked at each corner thereof. A loop at each corner of the towel enables a user to force the pocket inside-out, grab a handful of sand, and pull the sand into the pocket while returning the pocket to its normal configuration. Optionally, at least one additional pocket may be provided on the top surface of the towel for the storage of personnel effects and the like.

1 Claim, 3 Drawing Sheets

BEACH TOWEL

BACKGROUND OF THE INVENTION

1. Field of the Invention

This invention relates to the field of beach towels. More particularly, it relates to the field of beach towels including anchoring apparatus.

2. The Prior Art

Beach towels are well known in the art. However, as long as beach towels have been around, man has grappled with the problem of how to keep them from blowing away, folding over in the wind, and other similar problems all exacerbated by the presence of sand at the beach. People have even resorted to driving stakes into the sand in order to tie the beach towels down. What is needed is a convenient one piece beach towel which can be anchored conveniently in the sand at the beach without the use of additional tools and implements.

OBJECTS AND ADVANTAGES OF THE INVENTION

Accordingly, it is an object of the present invention to provide a beach towel which may be conveniently anchored to the sand at the beach without the use of additional tools and implements.

It is a further object of the present invention to provide a towel with four hand-operated integral pockets for holding sand which anchors the towel down.

Yet a further object of the present invention is to provide at least one additional pocket on the top side of the beach towel for the storage of personnel effects.

These and many other objects and advantages of the present invention will become apparent to those of ordinary skill in the art from a consideration of the drawings and ensuing description of the invention.

SUMMARY OF THE INVENTION

A beach towel according to the present invention has a top surface and a bottom surface. The beach towel may be rectangular or of another shape having at least three corners. The bottom surface is adapted to lay flat on the sand of a beach and is provided with a triangle-shaped pocked at each corner thereof. A loop at each corner of the towel enables a user to force the pocket inside-out, grab a handful of sand, and pull the sand into the pocket while returning the pocket to its normal configuration. Optionally, at least one additional pocket may be provided on the top surface of the towel for the storage of personnel effects and the like.

DESCRIPTION OF THE PREFERRED EMBODIMENTS

Those of ordinary skill in the art will realize that the following description of the present invention is illustrative only and is not intended to be in any way limiting. Other embodiments of the invention will readily suggest themselves to such skilled persons from an examination of the within disclosure.

The present invention is directed to a beach towel which includes a pocket at each corner for holding sand which anchors the towel against the forces of the wind at the beach. According to a preferred embodiment of the present invention, a rectangular towel having four corners is contemplated. This is not, however, to be construed as a requirement that the towel have four corners. A towel with three corners or more than four corners would also work and is intended to be covered by the claims appended hereto.

Figure 1:
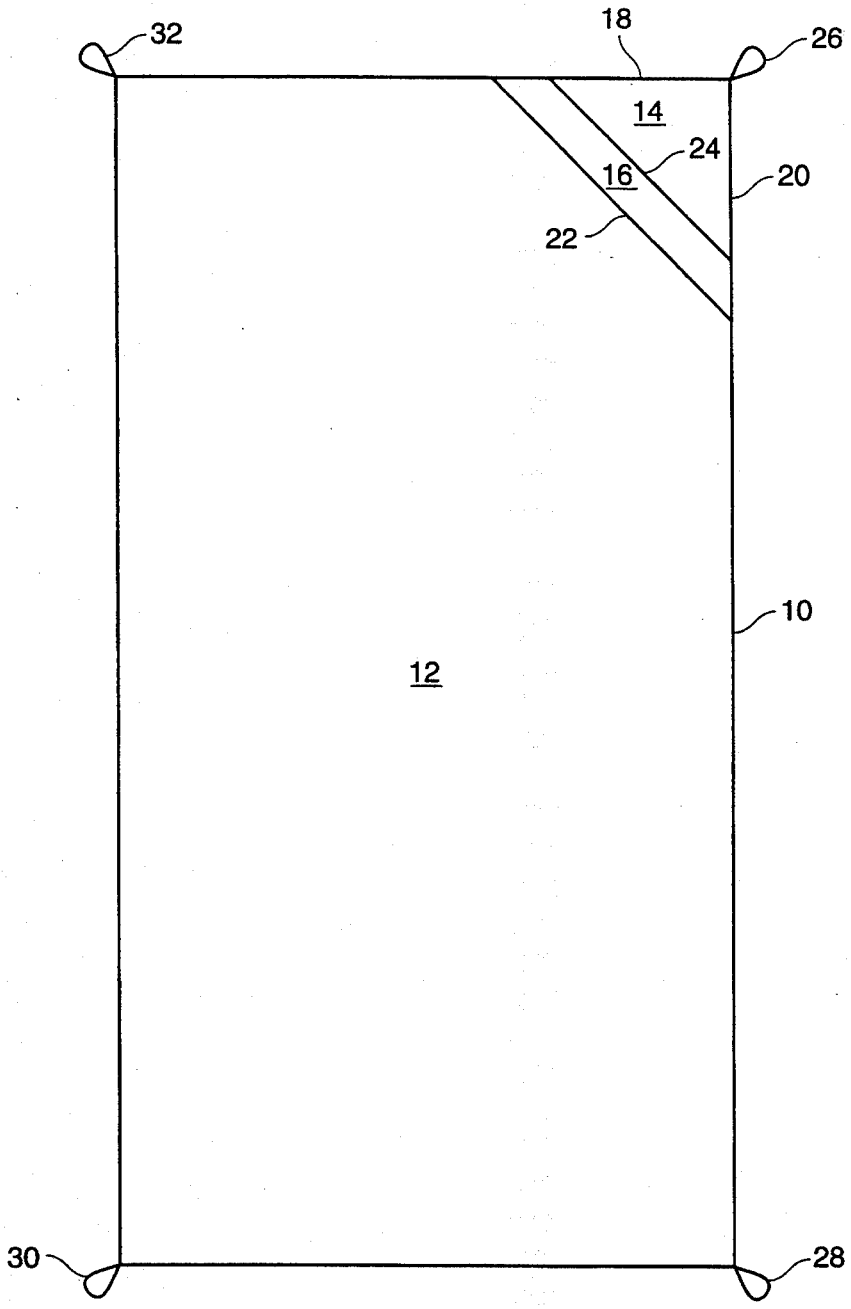
FIG. 1 is a diagram of the top surface of the beach towel according to a preferred embodiment of the present invention.

Turning now to the drawings, FIG. 1 depicts the top surface 12 of rectangular towel 10. Top surface 12 preferably includes at least one pocket 14 which is preferably triangular in shape and includes strip 16 which is used to close it. Pocket 14 is intended to be used for containing personal effects such as a wallet, car keys, and the like. Pocket 14 is attached to towel 10 at sides 18 and 20 with the remaining side (tucked under strip 16 and not visible in FIG. 1) left unstitched to form a pocket. Similarly, side 22 of strip 16 is stitched to towel 10 and side 24 of strip 16 is left unstitched so that it may be used to hold the edge of pocket 14 down and closed. Optionally hook and loop fasteners such as Velcro® brand hook and loop fasteners, zippers and other similar cloth-closing attachment means may be used to further secure the closure of pocket 14.

Towel 10 is preferably fabricated mainly of a standard terry cloth material.

At each corner of towel 10 is a loop (26, 28, 30, 32) which may be fabricated of cloth, cord, or a similar flexible material which may be conveniently attached to the corners of the towel 10.

Figure 2:
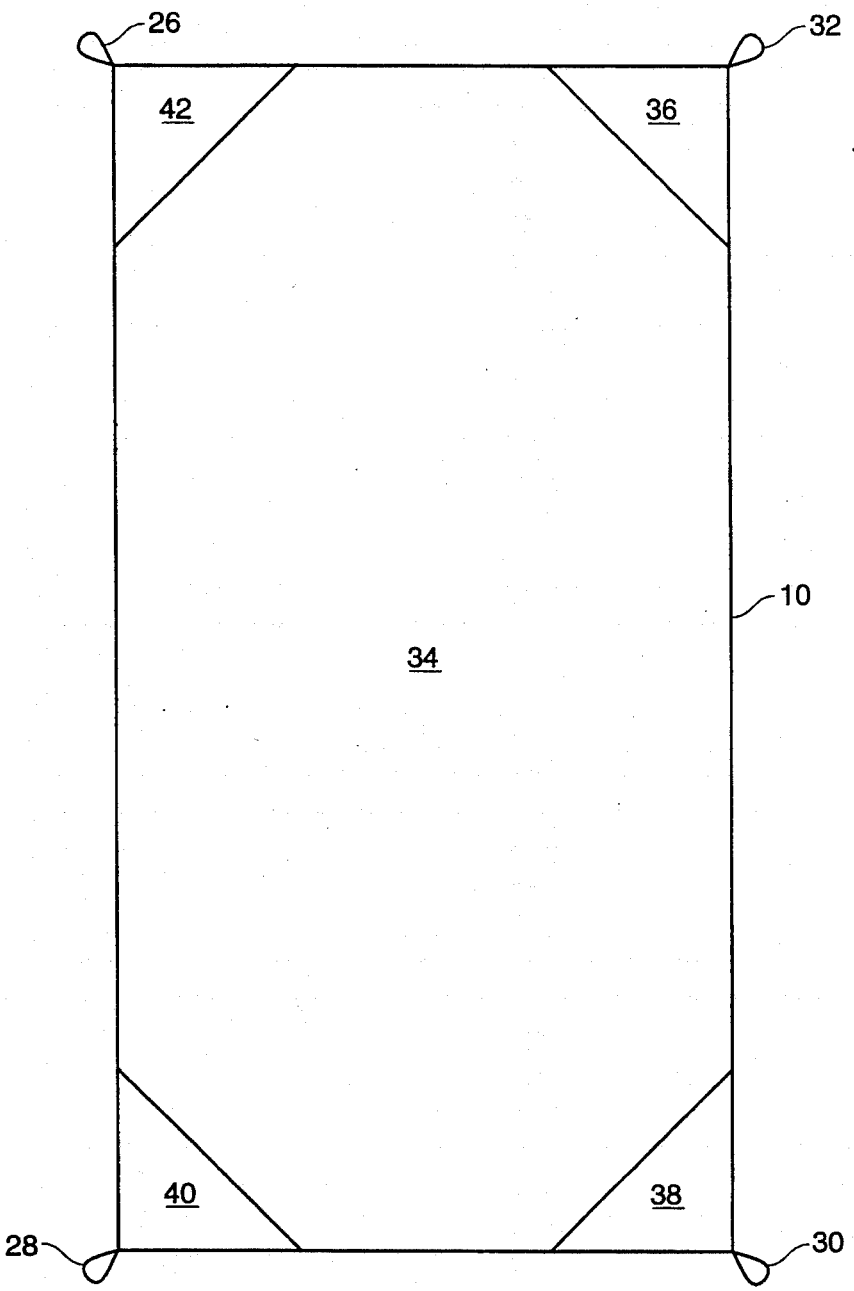
FIG. 2 is a diagram of the bottom surface of the beach towel according to a preferred embodiment of the present invention.

Turning now to FIG. 2, the underside 34 of towel 10 is depicted. Underside 34 comprises four corners each having a sand pocket (36, 38, 40, 42). The sand pockets are preferably triangular as shown and approximately 14 inches long along the two sides adjacent the sides of the towel. The pockets are preferably fabricated of a nylon material of a denser weave than the sand expected at the beach so that the sand does not pass through the weave and is easily ejected from the pockets.

Figure 3A:
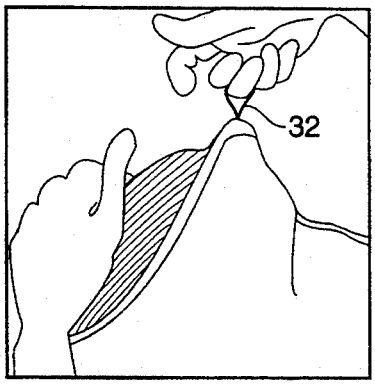
FIGS. 3A–3D are drawings showing the use of the sand pockets of the towel according to a preferred embodiment of the present invention.
Figure 3B:
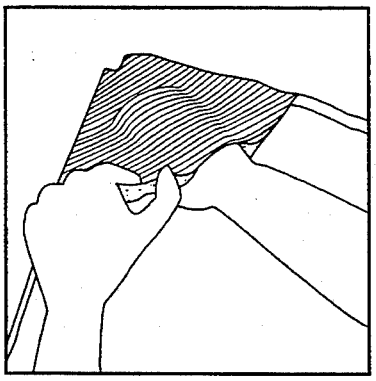
Figure 3C:
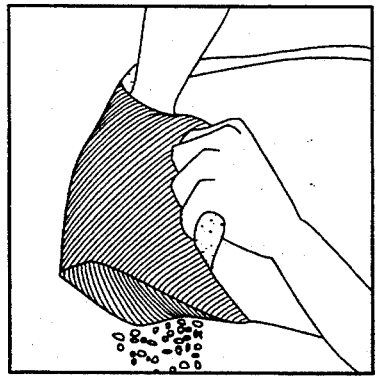
Figure 3D:
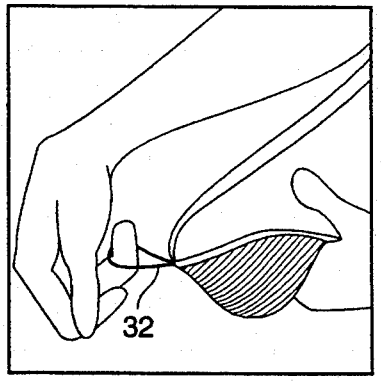

FIGS. 3A–3D depict the use of the sand pockets. In FIG. 3A the middle finger of the right hand is used to grasp loop 32. In FIG. 3B the left hand is used to make the pocket inside-out while the right hand continues to hold loop 32 (not shown). In FIG. 3C the right hand (now inside the inside-out pocket) grasps a handful of sand. In FIG. 3D the right hand is withdrawn pulling loop 32 back out and inverting the pocket back to its normal state—leaving the handful of sand inside.

Thus, without additional implements (other than the sand normally available at the beach) the towel may be easily anchored at the beach as shown above.

While illustrative embodiments and applications of this invention have been shown and described, it would be apparent to those skilled in the art that many more modifications than have been mentioned above are possible without departing from the inventive concepts set forth herein. The invention, therefore, is not to be limited except in the spirit of the appended claims.

What is claimed is:

1. A method of using a beach towel having a top surface, a bottom surface, a plurality of sand pockets located at corners of said bottom surface, and loops located at said corners, said method comprising the steps of:

(a) placing a finger of one hand through a loop located at a first corner of the towel;

(b) inverting the pocket adjacent said loop;

(c) grabbing a handful of sand with said one hand;

(d) pulling on said loop to re-invert the pocket adjacent aid loop while drawing said handful of sand into the pocket adjacent said loop.

* * * * *